US008626028B2

(12) United States Patent
Kim

(10) Patent No.: US 8,626,028 B2
(45) Date of Patent: Jan. 7, 2014

(54) IMAGE FORMING APPARATUS AND POWER TRANSMISSION UNIT HAVING A PLURALITY OF INTERMEDIATE GEARS USABLE WITH THE SAME

(75) Inventor: Jong-tae Kim, Gwacheon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 197 days.

(21) Appl. No.: 12/858,614

(22) Filed: Aug. 18, 2010

(65) Prior Publication Data

US 2011/0064471 A1 Mar. 17, 2011

(30) Foreign Application Priority Data

Dec. 15, 2009 (KR) ..... 10-2009-0124777

(51) Int. Cl.
*G03G 15/00* (2006.01)

(52) U.S. Cl.
USPC ..... 399/167; 399/299

(58) Field of Classification Search
USPC ..... 399/39, 66, 167, 297–301
See application file for complete search history.

(56) References Cited

U.S. PATENT DOCUMENTS

| | | | | |
|---|---|---|---|---|
| 5,970,286 | A * | 10/1999 | Numazu et al. | 399/167 |
| 2002/0003973 | A1 * | 1/2002 | Saito | 399/167 |
| 2005/0063734 | A1 * | 3/2005 | Saito et al. | 399/167 |
| 2007/0031166 | A1 * | 2/2007 | Zensai | 399/167 |
| 2009/0028589 | A1 | 1/2009 | Kim et al. | |

FOREIGN PATENT DOCUMENTS

KR 20080086810 9/2008

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming apparatus including a power transmission unit having a driving source, at least one image receptor which is rotatably driven by the driving source and on which a latent image is formed by exposure, and a power transmission unit which transmits power from the driving source to the image receptor. The power transmission unit includes an image receptor axial gear formed on the same axis as the image receptor, and a plurality of intermediate gears which transmits the power from the driving source to the image receptor axial gear. The number Tn of teeth of an n-th one of the plurality of intermediate gears with respect to the image receptor axial gear satisfies the following Inequality: $(I/Rn)-0.2 \leq Tn \leq (I/n)+0.2$, where, Rn is a reduction ratio from the n-th intermediate gear to the image receptor axial gear and I and n are a natural number.

24 Claims, 10 Drawing Sheets

IMAGE FORMING APPARATUS AND POWER TRANSMISSION UNIT HAVING A PLURALITY OF INTERMEDIATE GEARS USABLE WITH THE SAME

CROSS-REFERENCE TO RELATED APPLICATIONS

This application claims priority under 35 U.S.C. §119 from Korean Patent Application No. 10-2009-0124777, filed on Dec. 15, 2009 in the Korean Intellectual Property Office, the disclosure of which is incorporated herein by reference in its entirety.

BACKGROUND

1. Field of the General Inventive Concept

Apparatuses and methods consistent with the exemplary embodiments relate to an image forming apparatus and a power transmission unit usable with the same, and more particularly, to an image forming apparatus with color registration improved by correcting an eccentricity error of a power transmitting gear, and a power transmission unit usable with the same.

2. Description of the Related Art

In general, an image forming apparatus is an apparatus to print an image on a printing medium based on an input image signal. The image forming apparatus may be classified into a printer, a copier, a facsimile machine, a multifunction printer with integration of these functions, and others known in the art depending on its function and may be classified into an inkjet type, a thermal transfer type, an electro-photography type, and others known in the art depending on its printing type.

Among them, the electro-photography type image forming apparatus is an apparatus to print an image on a printing medium by scanning an image receptor charged by a predetermined potential with light to form a latent image thereon, developing the latent image with toner of a predetermined color, and transferring and fixing the developed latent image onto the printing medium. This electro-photography type image forming apparatus may be also classified into a mono type or a color type depending on its color representation capability.

An electro-photography type color image forming apparatus includes a plurality of developing units corresponding to different colors, for example, yellow, magenta, cyan and black to implement a full color image by superimposing images formed by the respective developing units. The implementation of full color requires a color registration to allow respective color images developed by the respective developing units to be matched in place. Unfortunately, such an electro-photography type color image forming apparatus may have a color misregistration which may be caused by complex factors. Among these complex factors, a main mechanical factor for color misregistration is an eccentricity error between gears of a power transmission unit which transmits power between a driving source and an image receptor. Such an eccentricity error may be attributed to a mechanical tolerance in gear manufacture, which may occur from a difference between outer diameters of gears, with the difference being more than several tens of microns with respect to a predetermined reference value.

SUMMARY

Accordingly, one or more exemplary embodiments of the present general inventive concept provide an image forming apparatus with a structure to reduce a color misregistration due to an eccentricity error between gears for power transmission, and a power transmission unit usable with the same.

Additional features and utilities of the present general inventive concept will be set forth in part in the description which follows and, in part, will be obvious from the description, or may be learned by practice of the general inventive concept.

Embodiments of the present general inventive concept may be achieved by providing an image forming apparatus including a driving source, at least one image receptor which is rotatably driven by the driving source and on which a latent image is formed by exposure, a power transmission unit which transmits power from the driving source to the image receptor, a developing unit which develops a toner image for the latent image formed on the image receptor, and a transferring unit which transfers the toner image developed on the image receptor onto a printing medium, wherein the power transmission unit includes an image receptor axial gear formed on the same axis as the image receptor, and a plurality of intermediate gears which transmits the power from the driving source to the image receptor axial gear, and wherein the number Tn of an n-th one of the plurality of intermediate gears with respect to the image receptor axial gear satisfies the following Inequality: $I/Rn-0.2 \leq Tn \leq I/Rn+0.2$, where, Rn is a reduction ratio from the n-th intermediate gear to the image receptor axial gear and I and n are a natural number.

An initial mounting position of at least some of the image receptor axial gear and the plurality of intermediate gears may be adjusted based on their respective run-out profiles.

The at least some of the image receptor axial gear and the plurality of intermediate gears may have reference marks which are the basis of determination of the run-out profiles.

The initial mounting position of at least some of the image receptor axial gear and the plurality of intermediate gears may be determined by accumulatively applying the following Equation along a gear train from the driving source to the image receptor axial gear.

$$\omega_2(t) = \frac{r_{p1} + \varepsilon_1 \cdot \sin(\omega_1 \cdot t + \varphi_1) - \varepsilon_2 \cdot \sin(\omega_1 \cdot t / R + \varphi_2)}{r_{p2} - \varepsilon_1 \cdot \sin(\omega_1 \cdot t + \varphi_1) + \varepsilon_2 \cdot \sin(\omega_1 \cdot t / R + \varphi_2)} \cdot \omega_1 \quad \text{[Equation]}$$

where, $\omega 1$ is an angular velocity of a driving one of two engaging gears, $\omega 2$ is an angular velocity of a driven one of the two engaging gears, R is a reduction ratio, rp1 is a radius of the driving gear, rp2 is a radius of the driven gear, $\Phi 1$ is an initial assembly reference angle from a reference position of the driving gear, $\Phi 2$ is an initial assembly reference angle from a reference position of the driven gear, $\epsilon 1$ is a run-out of the driving gear, and $\epsilon 2$ is a run-out of the driven gear.

The image receptor may include first to fourth image receptors provided for yellow, magenta, cyan and black colors, respectively.

The intermediate gears and the image receptor axial gear may be mounted with an objective function (O.F) satisfying the following Equation set as an initial assembly angle in consideration of a phase difference between AC components of the first to fourth image receptors.

$$O.F = w1x(F(Yx)+F(Mx)+F(Cx)+F(Kx)) + w2 \times F_\max(x) \quad \text{[Equation]}$$

where, F(Yx), F(Mx), F(Cx) and F(Kx) represent magnitudes of yellow, magenta, cyan and black print images, respectively, F_max(x) represents the maximum deviation between colors when an initial assembly angle X is selected, and w1 and w2 represent a weight for respective terms.

The plurality of intermediate gears may include a driving gear which is provided on a shaft of the driving gear, an idle gear which is driven in engagement with the driving gear, and a branch gear which engages with the idle gear and at least two of the plurality of image receptor axial gears, branches power transmitted from the idle gear, and transmits the branched power to the at least two image receptor axial gears.

Embodiments of the present general inventive concept may also be achieved by providing a power transmission unit usable with an image forming apparatus including a driving source and at least one image receptor which is rotatably driven by the driving source, including an image receptor axial gear formed on the same axis as the image receptor, and a plurality of intermediate gears which transmits power from the driving source to the image receptor axial gear, and wherein the number Tn of an n-th one of the plurality of intermediate gears with respect to the image receptor axial gear satisfies the following Inequality: $I/Rn-0.2 \leq Tn \leq I/Rn+0.2$, where, Rn is a reduction ratio from the n-th intermediate gear to the image receptor axial gear and I and n are a natural number.

The number Tn of teeth of the n-th intermediate gear may be set to be an integer multiple of a reduction ratio, and the teeth may be engaged at the same position in each rotation of the image receptor to result in a constant pattern of radial change in the image receptor axial gear such that a radial change in the image receptor axial gears for the respective color is minimized.

Embodiments of the present general inventive concept may be achieved by providing an image forming apparatus including a plurality of image receptors, a driving source to rotate the plurality of image receptors, a power transmission unit to deliver power from the driving source to the image receptors, the power transmission unit comprising a plurality of image receptor axial gears co-axial with the plurality of image receptors, and a plurality of intermediate gears to transmit the power provided by the driving source to the image receptor axial gears.

The plurality of intermediate gears may include a driving gear, a plurality of idle gears, and a plurality of branch gears, wherein the power transmission unit may transmit power provided by the driving source to the plurality of image receptors via the intermediate gears.

The plurality of intermediate gears may include a first branch gear to engage with a first idle gear and at least two of the plurality of image receptor axial gears.

The plurality of intermediate gears may include a second branch gear to engage with a second idle gear and at least two of the plurality of image receptor axial gears.

The plurality of idle gears and the plurality of branch gears may be implemented by two layers of gears in consideration of a gear reduction ratio.

A second layer gear of a first idle gear may have a radius smaller than a first layer gear thereof, and the first layer gear may engage with a first layer gear of the first branch gear.

A second layer gear of the first branch gear may have a radius smaller than a first layer gear thereof, and may engage with two of the plurality of image receptor axial gears.

The plurality of intermediate gears may have reference marks to align and mount the intermediate gears in the power transmission unit.

The reference marks of the intermediate gears may represent reference marks to correspond to the first layer gears and second layer gears.

The reference marks of the intermediate gears may have a rotation angle of 0°.

BRIEF DESCRIPTION OF THE DRAWINGS

The above and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
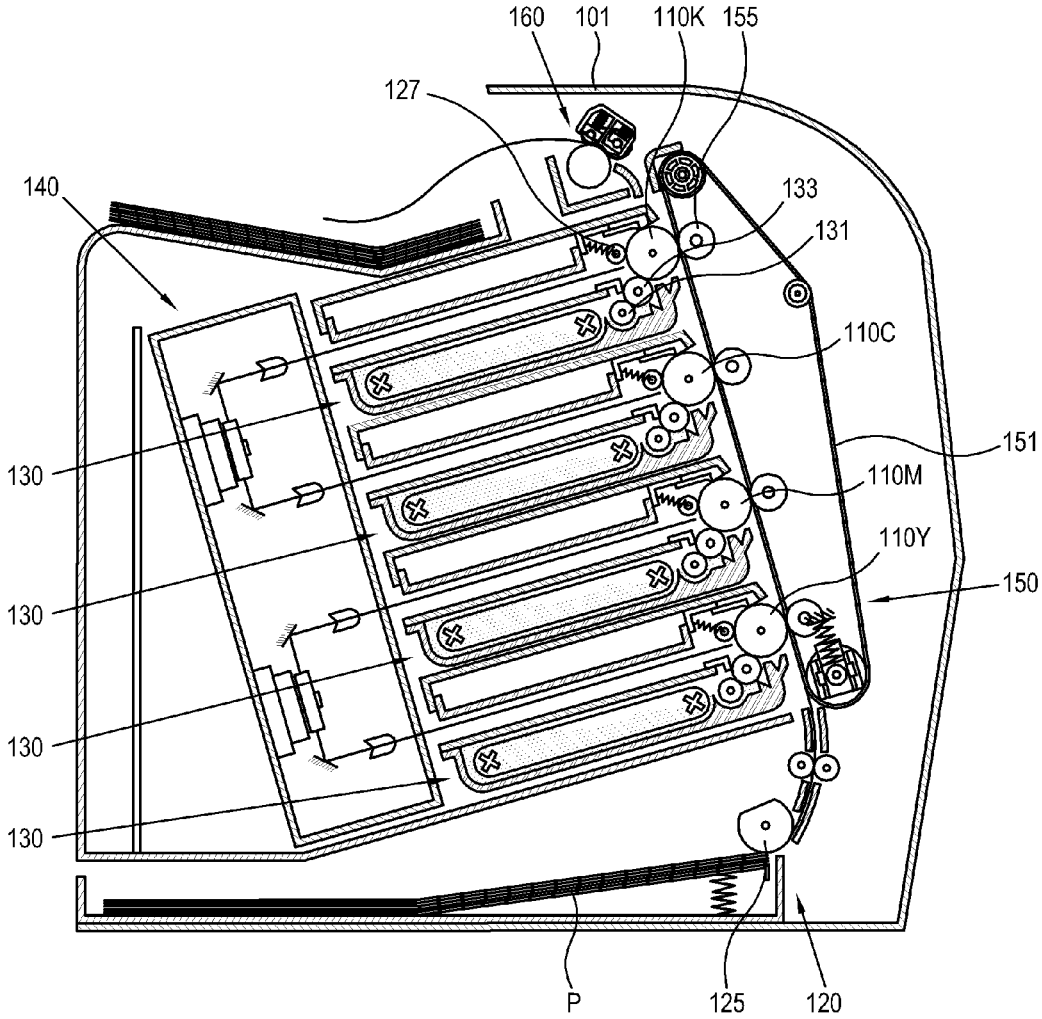
FIG. 1 is a schematic sectional view illustrating an image forming apparatus according to an exemplary embodiment of the present general inventive concept.

Below, exemplary embodiments will be described in detail with reference to accompanying drawings so as to be easily realized by a person having ordinary knowledge in the art.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
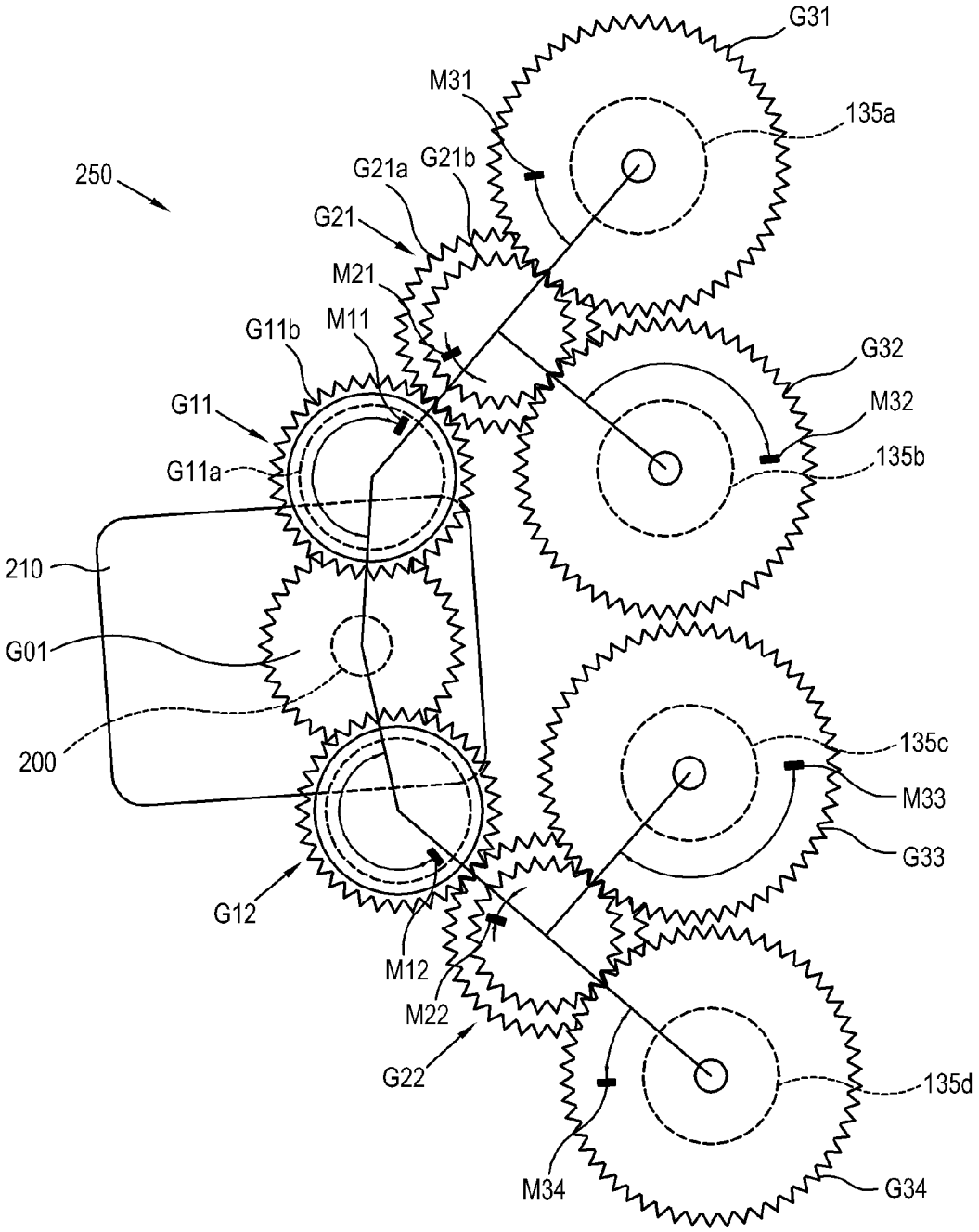
FIG. 2 is a schematic view illustrating a driving source, a power transmission unit and an image receptor in the image forming apparatus according to an exemplary embodiment of the present general inventive concept.

FIG. 1 is a schematic sectional view illustrating a color image forming apparatus according to an exemplary embodiment of the present general inventive concept, and FIG. 2 is a schematic view illustrating a driving source, a power transmission unit and an image receptor in the image forming apparatus according to an exemplary embodiment of the present general inventive concept.

Referring to FIGS. 1 and 2, a color image forming apparatus according to an example embodiment may be a tandem type color image forming apparatus to form a color image according to a single pass scheme and may include an image receptor 110, a developing unit 130, an optical scanning unit 140, a transferring unit 150, a driving source 210 and a power transmission unit 250.

A supply unit 120 on which printing media P are loaded may be detachably provided within a cabinet 101 forming a housing of the image forming apparatus. The printing media P loaded on the supply unit 120 may be picked up by a pick-up roller 125 and conveyed along a conveying path between the developing unit 130 and the transferring unit 150.

A plurality of image receptors 110 (110Y, 110M, 110C, 110K) may form a latent image for different colors in response to light beams emitted from the optical scanning unit 140. This embodiment illustrates first to fourth image receptors 110Y, 110M, 110C and 110K arranged in a directional order in which the printing media are supplied. For example, the first to fourth image receptors 110Y, 110M, 110C and 110K are provided in association with their respective yellow, magenta, cyan and black color to form color images.

A plurality of developing units 130 may develop and apply internal toner to the image receptors 110 so that toner images may be formed on the image receptors 110 for the respective colors. To this end, each of the developing units 130 may include a developing cartridge 131 in which toner is accommodated, developing roller 133 which develops an image using a potential difference with a developing nip formed between the developing roller 133 and the image receptors 110, and a charger 127 which charges the image receptors 110 to a predetermined potential. A developing unit 130 may be provided for each color. FIG. 1 illustrates four developing units 130 to implement respective yellow (Y), magenta (M), cyan (C) and black (K).

The optical scanning unit 140 may scan the plurality of image receptors 110 with a light to form latent images on the image receptors 110.

The transferring unit 150 may be arranged to face the image receptors 110, with a printing medium P to be interposed therebetween and conveyed along a conveying path, to transfer visible images formed on the image receptors 110 onto conveyed printing medium P. To achieve this purpose, the transferring unit 150 may include a transfer belt 151 and transfer backup rollers 155, all of which are arranged to face the plurality of image receptors 110. An image transferred onto the printing medium P through the transferring unit 150 may be fixed by heat and pressure from the fixing unit 160 to form single color or multiple color images thereon, as desired by a user or program.

The image receptors 110 may be rotated by a driving force which is provided by the driving source 210 and delivered via the power transmission unit 250 illustrated in FIG. 2. While the image receptors 110 are being rotated, images developed on the surfaces thereof may be transferred onto the printing medium P. FIG. 1 illustrates a direct transfer type image forming apparatus, by way of example, where images developed on the image receptors 110 are directly transferred onto the printing medium P. The illustrated direct transfer scheme is merely one example. The spirit of the present general inventive concept may be equally applied to an indirect transfer type image forming apparatus to indirectly transfer an image onto the printing medium by the medium of the transferring unit 150. In addition, although this example embodiment illustrates the image receptor provided for each color and the image forming apparatus which forms a full color image using the single pass scheme, the present general inventive concept is not limited thereto but may be equally applied to an image forming apparatus employing a multi pass scheme.

Referring to FIGS. 1 and 2, the image receptors 110 may be rotated by power which is provided by the driving source 210 and is delivered via the power transmission unit 250.

The power transmission unit 250 may include a plurality of image receptor axial gears G31, G32, G33 and G34 formed on the same axes, also known as co-axes of the plurality of image receptors 110, respectively, and a plurality of intermediate gears G01, G11, G12, G21 and G22 which may transmit power of the driving source 210 to the image receptor axial gears G31, G32, G33 and G34 that correspond to the image receptors 110K, 110C, 110K and 110Y, respectively.

In this embodiment, the plurality of intermediate gears may include a driving gear G01 provided on a shaft 200 of the driving source 210, idle gears G11 and G12 which are driven in engagement with the driving gear G01, and branch gears G21 and G22. In this embodiment, the power transmission unit may be configured to transmit the power provided by the driving source 210 to the first to fourth image receptors 110Y, 110M, 110C and 110K. To this end, the idle gears may include first and second idle gears G11 and G12 which engage with a gear train of the driving gear G10, and the branch gears may include first and second branch gears G21 and G22. The first branch gear G21 may engage with the first idle gear G11 and at least two (e.g., G31 and G32) of the plurality of image receptor axial gears, and the second branch gear G22 may engage with the second idle gear G12 and at least two (e.g., G33 and G34) of the plurality of image receptor axial gears. In this embodiment, the idle gears G11 and G12 and the branch gears G21 and G22 may be implemented by two layers of gears in consideration of a gear reduction ratio. More specifically, a second layer gear G11*a* (illustrated by a dotted line) of the first idle gear G11 may have a radius smaller than that of a first layer gear G11*b* thereof and may engage with the driving gear G01, and the first layer gear G11*b* may engage with a first layer gear G21*a* of the first branch gear G21. A second layer gear G21*b* of the first branch gear G21 has a radius smaller than that of the first layer gear G21*a* and may engage with the image receptor axial gears G31 and G32. The second layer gear Gila may also engage with the driving gear G01 to provide driving power to the branch gear G21 and to the image receptor axial gears G31 and G32.

The second idle gear G12 and the second branch gear G22 have substantially the same gear configuration and gear engagement as the first idle gear G11 and the first branch gear G21, respectively.

The above-described intermediate gears and image receptor axial gears have a run-out, i.e., an eccentricity, for various reasons in a manufacturing process, such as injection molding conditions, gate position of a mold, etc. Such a run-out of the intermediate gears and image receptor axial gears may change a linear velocity of the first to fourth image receptors 110Y, 110M, 110C and 110K, which may result in a color misregistration.

In order to avoid such a color misregistration, the present general inventive concept can minimize color misregistration by adjusting an initial mounting position and optimizing the number of teeth of the intermediate gears based on run-out data representing an eccentricity form of each gear without controlling a speed of the driving source.

More specifically, in the power transmission unit of the image forming apparatus according to the present general inventive concept, the number Tn of teeth of an n-th intermediate gear (n is a natural number) of the plurality of intermediate gears arranged with respect to the image receptor axial gears G31, G32, G33 and G34 may be set to be an integer multiple of a reduction ratio from the n-th intermediate gear to the image receptor axial gears, as expressed by Inequality 1. In Inequality 1, −0.2 and +0.2 represent error ranges.

$$(I/Rn)-0.2 \leq Tn \leq (I/Rn)+0.2 \quad \text{[Inequality 1]}$$

Where, Rn is a gear reduction ratio from the n-th intermediate gear to the image receptor axial gears and I and n are natural numbers. The reduction ratio Rn is representative of the relationship between the numbers of teeth on the gears that are meshed. Rn may thus be the ratio of the number of teeth of an image receptor axial gear divided by a number of teeth of an n-th intermediate gear.

In this manner, when the number Tn of teeth of the n-th intermediate gear is set to be an integer multiple of the reduction ratio, teeth of the intermediate gears are engaged at the same position in each rotation of the image receptors, which may result in a constant pattern of radial change in the image receptor axial gears due to the run-out. Accordingly, by adjusting initial mounting positions of at least some of the image receptor axial gears G31, G32, G33 and G34 and the plurality of intermediate gears G01, G11, G12, G21 and G22 within a range to satisfy Inequality 1 according to a run-out profile for each gear, it is possible to minimize a radial change in the image receptor axial gears G31, G32, G33 and G34 for the respective colors.

For example, if the number of teeth of an image receptor axial gear is 54 and the number of teeth in an intermediate gear is 36, the reduction ratio is 1.5. Thus, a number of teeth that are multiples of 1.5 that divide evenly into 54 may be set for the number of teeth of an intermediate gear. In this way the number of teeth of an intermediate gear will result in the constant pattern of radial change in the image receptor axial gears due to run-out, or eccentricity of the gears FIG. 3 is a schematic view illustrating an example of gear train phase angle adjustment between gears of the power transmission unit in the image forming apparatus according to an exemplary embodiment of the present general inventive concept.

Figure 3:
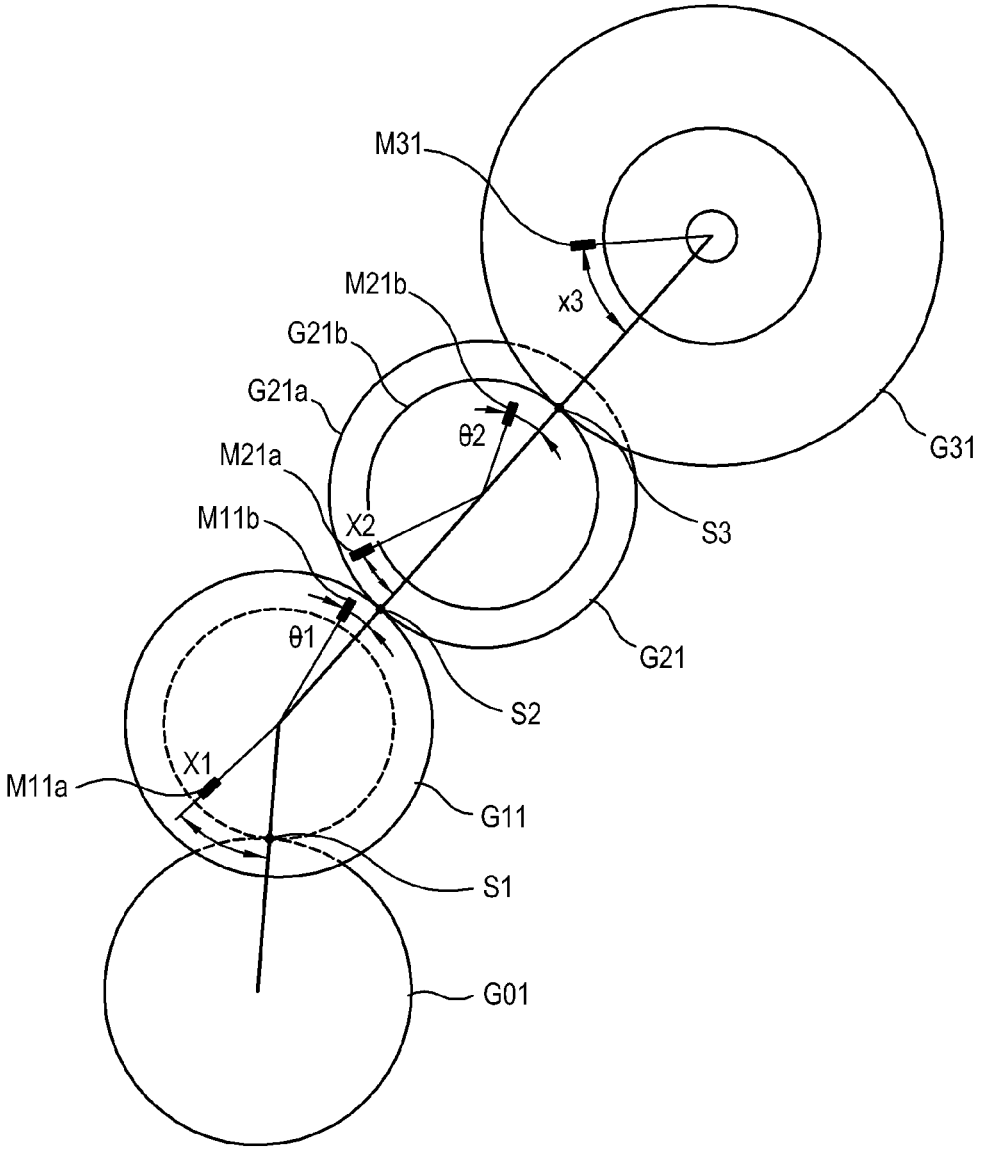
FIG. 3 is a schematic view illustrating an example of gear train phase angle adjustment between gears of the power transmission unit in the image forming apparatus according to an exemplary embodiment of the present general inventive concept.
Figure 4:
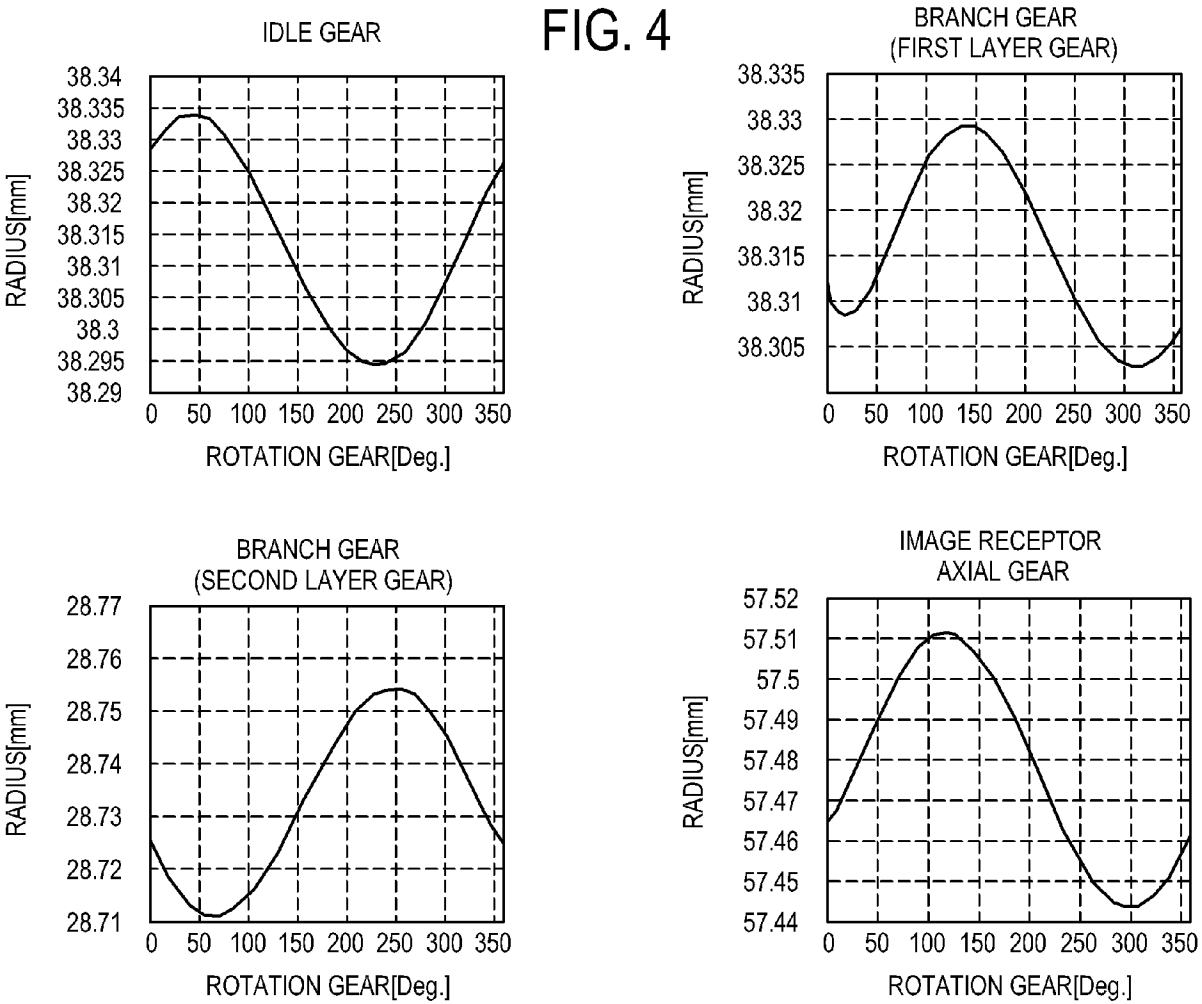
FIG. 4 is a graph illustrating an example of run-out measurement data of an idle gear, a branch gear and an image receptor axial gear.

Referring to FIGS. 2 and 3, at least some of the image receptor axial gears G31, G32, G33 and G34 and the plurality of intermediate gears G01, G11, G12, G21 and G22 include reference marks M11, M12, M21, M22, M31, M32, M33, M34 which are used to align the gears and are the basis of determination for the run-out profile. The run-out profile for each gear is determined based on the reference marks M11, M12, M21, M22, M31, M32, M33, M34 for the intermediate gears and the image receptor axial gears. More specifically, with the reference marks as a rotation angle of 0°, if the idle gears G11 and G12, the first and second layer gears G21*a* and G21*b* of the branch gears G21 and G22, and the image receptor axial gear G31 show run-out measurement results as illustrated in FIG. 4, it is possible to minimize a variation by mounting gears with mounting phases of reference marks M11*e*, M11*b*, M21*a*, M21*b* and M31 rotated by angles X1, X2, θ1, θ2 and X3, respectively, from reference points S1, S2 and S3 to minimize a color misregistration through a numerical analysis. As illustrated in FIG. 3, the angles X1, X2, θ1, θ2 and X3 represent reference marks to correspond to the first layer gears and second layer gears, while the marks M11, M21, M12 and M22 illustrated in FIG. 2 correspond to the reference marks of the second layer years. By providing reference marks of the first and second layer gears, mounting variation may be minimized.

The numerical analysis used to determine the initial mounting positions of the image receptor axial gear G31 and the plurality of intermediate gears may be an accumulative application of the following Equation 1 along a gear train from the driving gear G01 to the image receptor axial gear G31. In configuration of the power transmission unit to satisfy Equation 1, the initial mounting positions can be determined based on the above-described numerical analysis.

$$\omega_2(t) = \frac{r_{p1} + \varepsilon_1 \cdot \sin(\omega_1 \cdot t + \varphi_1) - \varepsilon_2 \cdot \sin(\omega_1 \cdot t/R + \varphi_2)}{r_{p2} - \varepsilon_1 \cdot \sin(\omega_1 \cdot t + \varphi_1) + \varepsilon_2 \cdot \sin(\omega_1 \cdot t/R + \varphi_2)} \cdot \omega_1 \quad \text{[Equation 1]}$$

Where, $\omega_1$ is an angular velocity of a driving one of two engaging gears, $\omega_2$ is an angular velocity of a driven one of the two engaging gears, R is a reduction ratio, $r_{p1}$ is a radius of the driving gear, $r_{p2}$ is a radius of the driven gear, $\phi_1$ is an initial assembly reference angle from a reference position of the driving gear, $\phi_2$ is an initial assembly reference angle from a reference position of the driven gear, $\epsilon_1$ is a run-out of the driving gear, and $\epsilon_2$ is a run-out of the driven gear.

FIG. 4 is a graph illustrating an example of run-out measurement data depending on a rotation angle when reference marks of an idle gear, first and second layer gears of a branch gears and an image receptor axial gear are set to be 0°.

Referring to FIG. 4, for the idle gear G11, if it is designed to have a radius of 38.31 mm, it can be seen that the radius is varied within a range of about 38.295 mm to about 38.335 mm as a run-out due to an effect of a mold characteristic and the like and may have a sinusoidal waveform with the maximum value at a rotation angle of about 50° and the minimum value at the rotation angle of about 220°. For the first layer gear G21*a* of the branch gear G21, if it is designed to have the same radius of 38.31 mm as the idle gear G11, it can be seen that the radius is varied within a range of about 38.30 mm to about 38.33 mm as a run-out and has a sinusoidal waveform with the maximum value at the rotation angle of about 150° and the minimum value at the rotation angle of about 320°. For the second layer gear G21*b* of the branch gear G21, if it is designed to have a radius of 28.733 mm, it can be seen that the radius is varied within a range of about 28.71 mm to about 28.755 mm as a run-out and has a sinusoidal waveform with the minimum value at the rotation angle of about 60° and the maximum value at the rotation angle of about 250°. For the image receptor axial gear G31, if it is designed to have a radius of 57.466 mm, which is double the radius of the second layer gear G21*b* of the branch gear G21, it can be seen that the radius is varied within a range of about 57.445 mm to about 57.51 mm as a run-out and has a sinusoidal waveform with the maximum value at the rotation angle of about 120° and the minimum value at the rotation angle of about 300°.

Figure 5:
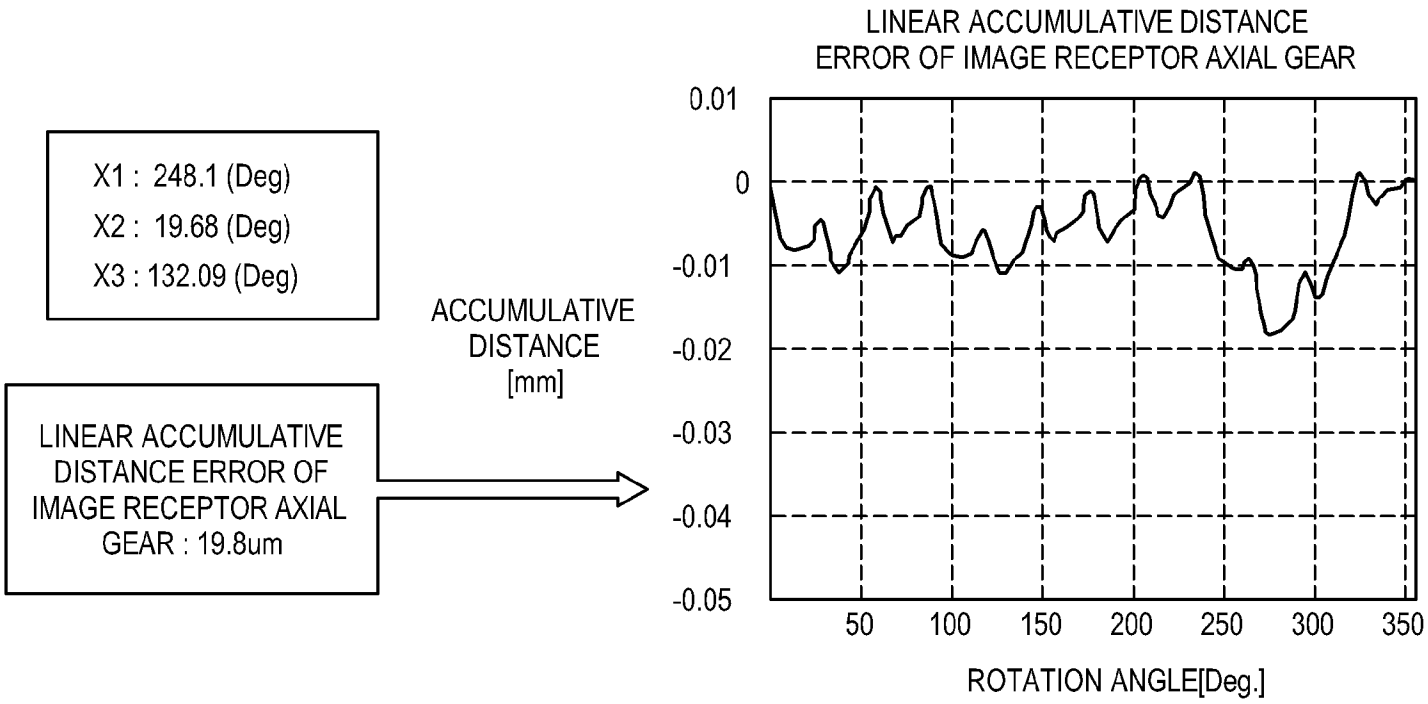
FIG. 5 is a graph illustrating a change of the image receptor axial gear in a radial direction when the idle gear, the branch gear and the image receptor axial gear having the run-out components illustrated in FIG. 4 are optimally placed to satisfy Inequality 1 and Equation 1.

FIG. 5 is a graph illustrating a radial change in the image receptor axial gear when the idle gear, the branch gear and the image receptor axial gear having the run-out components illustrated in FIG. 4 are optimally placed to satisfy Inequality 1 and Equation 1.

Referring to FIG. 5, if the gears have the run-out components as illustrated in FIG. 4 and if angles X1, X2 and X3 between the reference marks and combination reference positions are set to be 248.1°, 19.68° and 132.09°, respectively, it can be seen that a linear accumulative distance error of the image receptor axial gear G31 is 19.8 μm, giving a small eccentricity. Accordingly, although eccentricities of the image receptors 110K, 110C, 110M and 110Y for the respective colors are individually adjusted as illustrated in FIG. 5, since the eccentricities of the image receptors are small, it is possible to significantly reduce a color misregistration between images formed on the image receptors.

Figure 6A:
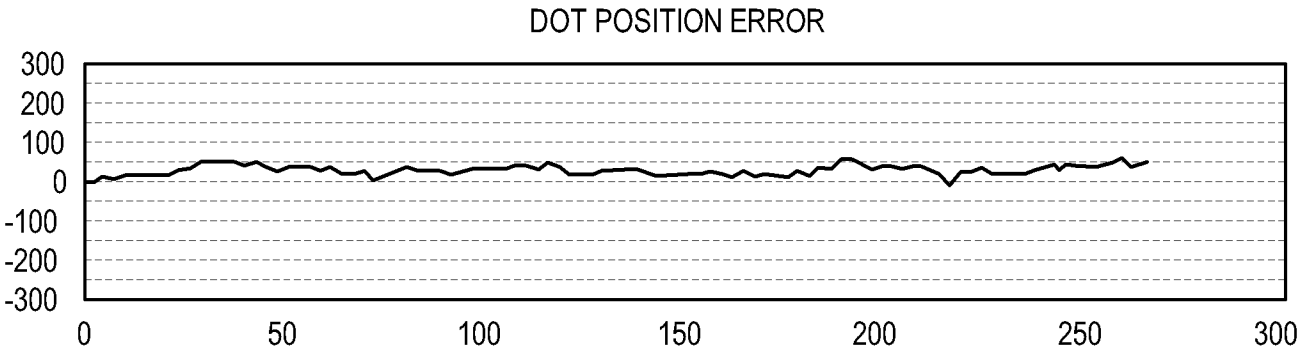
FIGS. 6A and 6B are graphs illustrating a dot position error and a color position error for each color when the idle gear, the branch gear and the image receptor axial gear having the run-out components illustrated in FIG. 4 are optimally placed to satisfy Inequality 1 and Equation 1.
Figure 6B:
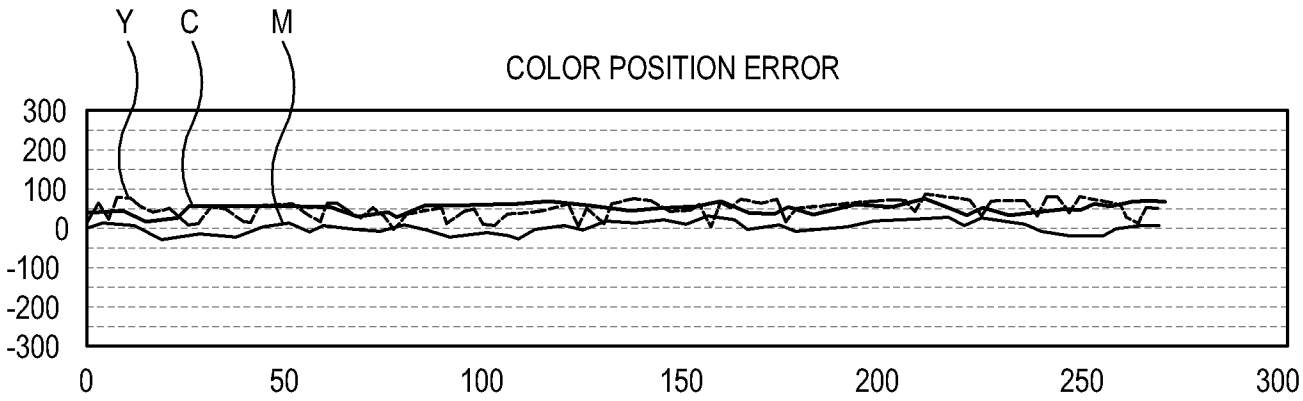

FIGS. 6A and 6B are graphs illustrating a dot position error and a color position error in an axial direction of image receptors when gears are mounted with their eccentricities adjusted according to an exemplary embodiment of the present general inventive concept.

Referring to FIG. 6A, when the power transmission unit is provided to satisfy Inequality 1 and Equation 1, it can be seen that a dot position error remains within an error range of no more than about 50 μm. Referring to FIG. 6B, it can be seen that a color position error for each of yellow (Y), magenta (M), cyan (C) and black (K) remains within an error range of no more than about 100 μm, illustrating a color matching. This illustrates a significantly reduced color misregistration.

Figure 7:
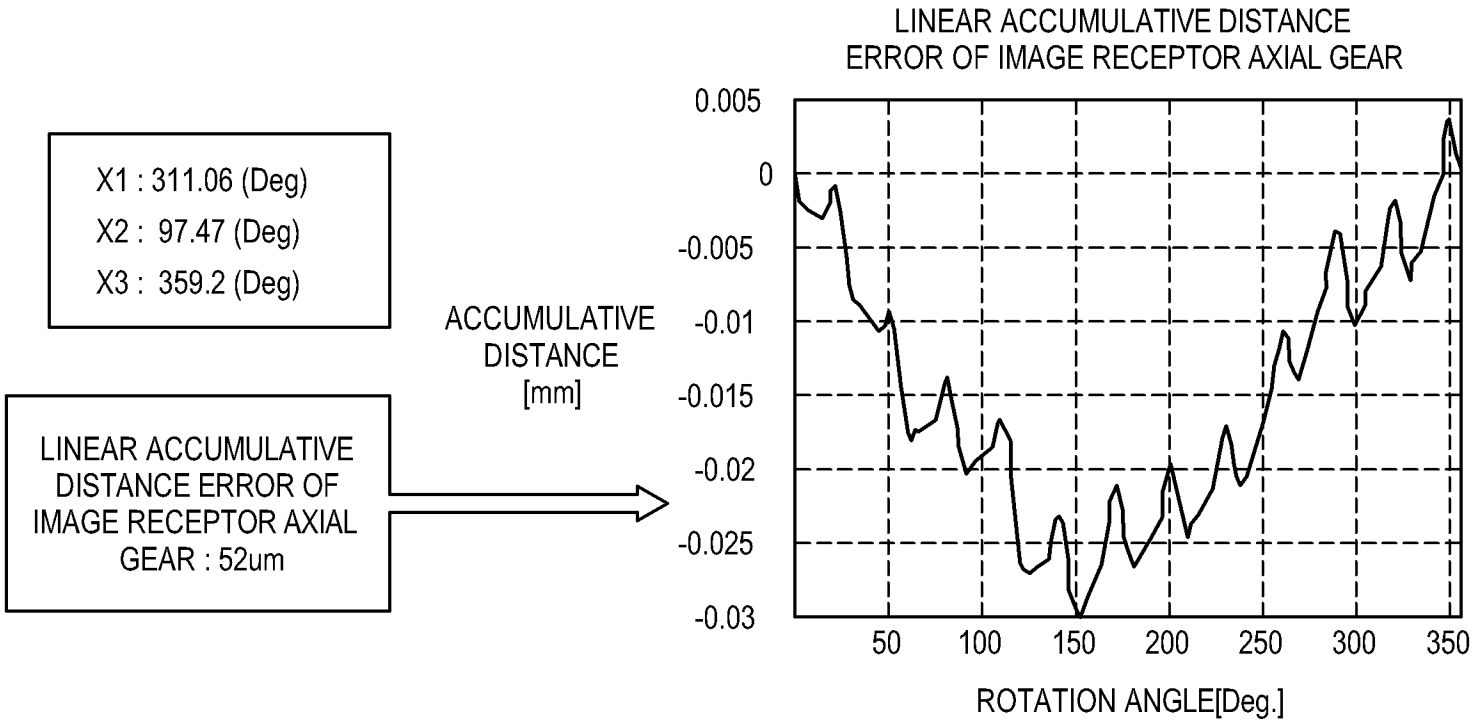
FIG. 7 is a graph illustrating a change of the image receptor axial gear in a radial direction in a comparative example where the idle gear, the branch gear and the image receptor axial gear having the run-out components illustrated in FIG. 4 are placed at their worst.

FIG. 7 is a graph illustrating a radial change in an image receptor axial gear in a comparative example where the idle gears, the branch gears and the image receptor axial gears having the run-out components illustrated in FIG. 4 are placed at their worst case scenarios.

Referring to FIG. 7, if angles X1, X2 and X3 between the reference marks illustrated in FIG. 3 and combination reference positions are set to be 311.06°, 97.47° and 359.2°, respectively, it can be seen that a linear accumulative distance error of the image receptor axial gear is 52 μm, which is about 2.5 times the linear accumulative distance error obtained when the gear is optimally placed. In this case, the dot position error and the color position error of this worst case scenario are illustrated in FIGS. 8A and 8B, respectively.

Figure 8A:
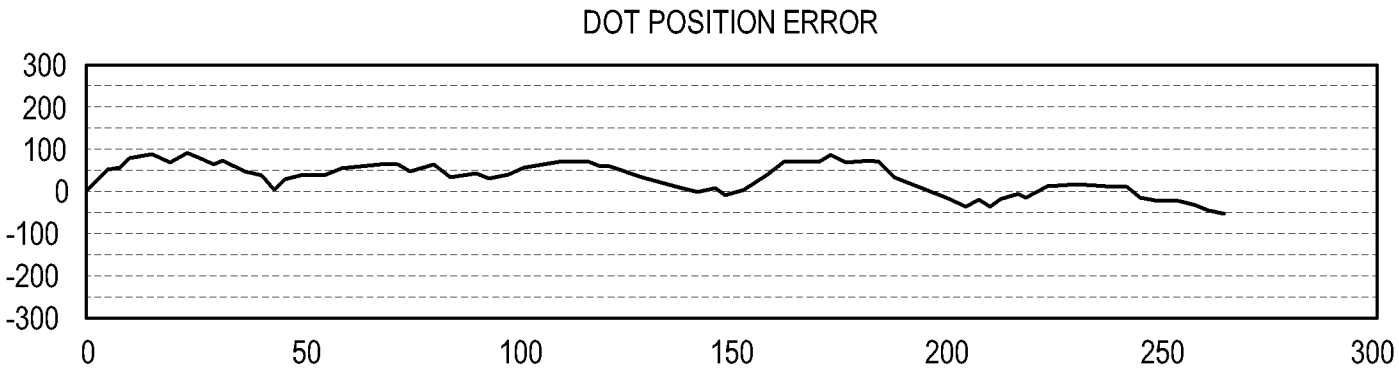
FIGS. 8A and 8B are graphs illustrating a dot position error and a color position error for each color in a comparative example where the idle gear, the branch gear and the image receptor axial gear having the run-out components illustrated in FIG. 4 are placed at their worst.
Figure 8B:
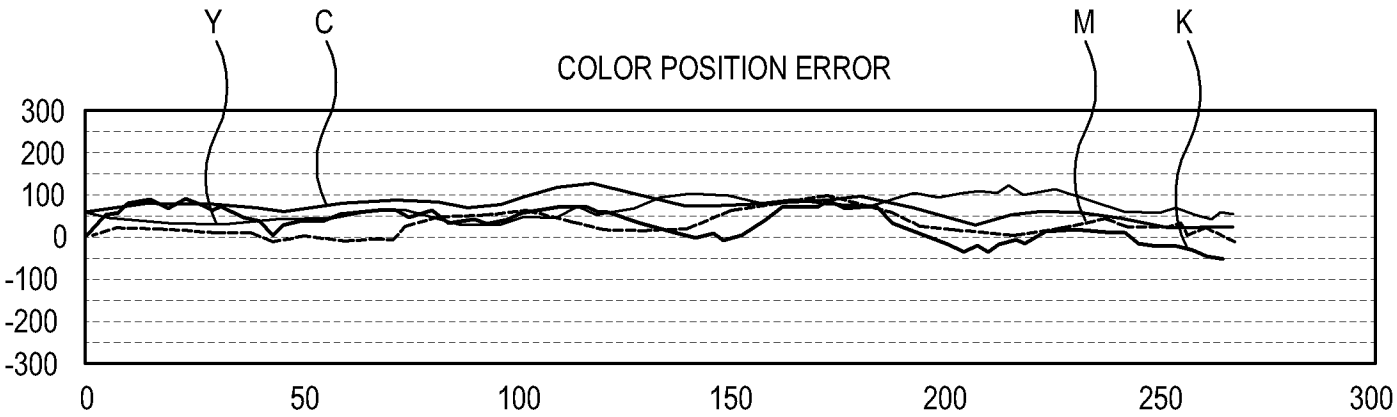

Referring to FIG. 8A, the dot position error in the comparative example has an error range of up to about 150 μm, which is about three times the error range in this embodiment. Referring to FIG. 8B, it can be seen that the color position error for each color also has a relatively wide error range of up to about 150 μm.

Accordingly, from a comparison between FIGS. 6A, 6B, 7, 8A and 8B, it can be seen that a color registration can be improved by adjusting an assembly phase between gears forming the power transmission unit in connection with a change in speed of the image receptor axial gears which are a final stage.

As described above, the image forming apparatus according to this embodiment can minimize the dot position error for each color by optimizing the number of teeth and the assembly angle of the gears forming the power transmission structure for each image receptor, with no consideration of a mounting position between adjacent image receptors, to satisfy Inequality 1 and Equation 1, as a way of minimizing a color misregistration. Accordingly, when a color image is formed by combining a plurality of colors, a color misregistration can be minimized, and an assemblability can be improved since a change in a radius of each image receptor and a change in a gap between adjacent image receptors have no effect on determination of an initial phase angle of the gears.

Furthermore, embodiments of the present general inventive concept can further minimize a misregistration of a color image to be printed in consideration of a phase difference between AC components of the first to fourth image receptors 110Y, 110M, 110C and 110K. To this end, the intermediate gears and the image receptor axial gears may be mounted with an objective function (O.F) satisfying the following Equation 2 set as an initial assembly angle.

$$\text{O.F}=w1\times(F(Yx)+F(Mx)+F(Cx)+F(Kx))+w2\times F_\max(x)$$

Where, F(Yx), F(Mx), F(Cx) and F(Kx) represent magnitudes of yellow, magenta, cyan and black print images, respectively, F_max(x) represents the maximum deviation between colors when an initial assembly angle X is selected, and w1 and w2 represent a weight for respective terms.

In this manner, when the initial assembly angle is set to satisfy Equation 2 in addition to Inequality 1 and Equation 1, color position error graphs of adjacent image receptors has a similar pattern, which allows a color misregistration to be minimized.

As described above, the image forming apparatus and the power transmission unit usable with the same according to example embodiments can minimize the dot position error for each color by optimizing the number of teeth and the assembly angle of the gears forming the power transmission structure for each image receptor, with no consideration of a mounting position between adjacent image receptors, to satisfy Inequality 1 and Equation 1, as a way of minimizing a color misregistration. Accordingly, when a color image is formed by combining a plurality of colors, a color misregistration can be minimized, and an assemblability can be improved since a change in a radius of each image receptor and a change in a gap between adjacent image receptors have no effect on determination of an initial phase angle of the gears.

Furthermore, embodiments of the present general inventive concept may allow color position error graphs of adjacent image receptors to have a similar pattern by mounting the intermediate gears and the image receptor axial gears with the objective function (O.F) satisfying Equation 2 set as the initial assembly angle in consideration of a phase difference between AC components of the first to fourth image receptors, which results in further minimization of a color misregistration.

Although a few exemplary embodiments have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a driving source;

at least one image receptor which is rotatably driven by the driving source and on which a latent image is formed;

a power transmission unit which transmits power from the driving source to the image receptor;

a developing unit which develops a toner image for the latent image formed on the image receptor; and a transferring unit which transfers the toner image developed on the image receptor onto a printing medium, wherein the power transmission unit includes:

an image receptor axial gear formed on the same axis as the image receptor; and a plurality of intermediate gears which transmits the power from the driving source to the image receptor axial gear, wherein a number Tn of teeth of one of the plurality of intermediate gears located at an n-th position away from the image receptor axial gear satisfies the following Inequality 1:

$$(I/Rn)-0.2\leq Tn\leq(I/Rn)+0.2$$

where Rn is a reduction ratio from the one of the plurality of intermediate gears located at the n-th position to the image receptor axial gear, and I and n are natural numbers, wherein the number Tn is set to be substantially an integer multiple of the reduction ratio and is a natural number.

2. The image forming apparatus according to claim 1, wherein an initial mounting position of at least some of the image receptor axial gear and the plurality of intermediate gears is adjusted based on their respective run-out profiles.

3. The image forming apparatus according to claim 2, wherein the at least some of the image receptor axial gear and the plurality of intermediate gears have reference marks which are the basis of determination of the run-out profiles.

4. The image forming apparatus according to claim 2, wherein the initial mounting position of at least some of the image receptor axial gear and the plurality of intermediate gears is determined by accumulatively applying the following Equation 1 along a gear train from the driving source to the image receptor axial gear:

$$\omega_2(t) = \frac{r_{p1} + \varepsilon_1 \cdot \sin(\omega_1 \cdot t + \varphi_1) - \varepsilon_2 \cdot \sin(\omega_1 \cdot t / R + \varphi_2)}{r_{p2} - \varepsilon_1 \cdot \sin(\omega_1 \cdot t + \varphi_1) + \varepsilon_2 \cdot \sin(\omega_1 \cdot t / R + \varphi_2)} \cdot \omega_1$$

where $\omega_1$ is an angular velocity of a driving one of two engaging gears, $\omega_2$ is an angular velocity of a driven one of the two engaging gears, R is a reduction ratio, $r_{p1}$ is a radius of the driving gear, $r_{p2}$ is a radius of the driven gear, $\phi_1$ is an initial assembly reference angle from a reference position of the driving gear, $_2$ is an initial assembly reference angle from a reference position of the driven gear, $\epsilon_1$ is a run-out of the driving gear, and $\epsilon_2$ is a run-out of the driven gear.

5. The image forming apparatus according to claim 1, wherein the image receptor includes first to fourth image receptors provided for yellow, magenta, cyan and black colors, respectively.

6. The image forming apparatus according to claim 5, wherein the intermediate gears and the image receptor axial gear are mounted with an objective function (O.F) satisfying the following Equation 2 set as an initial assembly angle in consideration of a phase difference between AC components of the first to fourth image receptors:

$$\text{O.F}=w1\times(F(Yx)+F(Mx)+F(Cx)+F(Kx))+w2\times F_\max(x)$$

where F(Yx), F(Mx), F(Cx) and F(Kx) represent magnitudes of the AC components of yellow, magenta, cyan and black print images on the first to fourth image receptors, respectively, F_max(x) represents the maximum deviation between colors when an initial assembly angle X is selected, and w1 and w2 represent a weight for respective terms.

7. The image forming apparatus according to claim 1, wherein the plurality of intermediate gears includes:

a driving gear which is provided on a shaft of the driving source;

an idle gear which is driven in engagement with the driving gear; and a branch gear which engages with the idle gear and at least two of the plurality of image receptor axial gears, branches power transmitted from the idle gear, and transmits the branched power to the at least two image receptor axial gears.

8. A power transmission unit usable with an image forming apparatus including a driving source and at least one image receptor which is rotatably driven by the driving source, comprising:

an image receptor axial gear formed on the same axis as the image receptor; and a plurality of intermediate gears which transmit power from the driving source to the image receptor axial gear, wherein the number Tn of teeth of one of the plurality of intermediate gears located at an n-th position away from the image receptor axial gear satisfies the following Inequality 2:

$$(I/Rn)-0.2 \le Tn \le (I/Rn)+0.2$$

where Rn is a reduction ratio from the one of the plurality of intermediate gears located at the n-th position to the image receptor axial gear, and I and n are natural numbers, wherein the number Tn is set to be substantially an integer multiple of the reduction ratio and is a natural number.

9. The power transmission unit according to claim 8, wherein an initial mounting position of at least some of the image receptor axial gear and the plurality of intermediate gears is adjusted based on their respective run-out profiles.

10. The power transmission unit according to claim 9, wherein the at least some of the image receptor axial gear and the plurality of intermediate gears have reference marks which are the basis of determination of the run-out profiles.

11. The power transmission unit according to claim 9, wherein the initial mounting position of at least some of the image receptor axial gear and the plurality of intermediate gears is determined by accumulatively applying the following Equation 3 along a gear train from the driving source to the image receptor axial gear:

$$\omega_2(t) = \frac{r_{p1} + \varepsilon_1 \cdot \sin(\omega_1 \cdot t + \varphi_1) - \varepsilon_2 \cdot \sin(\omega_1 \cdot t / R + \varphi_2)}{r_{p2} - \varepsilon_1 \cdot \sin(\omega_1 \cdot t + \varphi_1) + \varepsilon_2 \cdot \sin(\omega_1 \cdot t / R + \varphi_2)} \cdot \omega_1$$

where $\omega_1$ is an angular velocity of a driving one of two engaging gears, $\omega_2$ is an angular velocity of a driven one of the two engaging gears, R is a reduction ratio, $r_{p1}$ is a radius of the driving gear, $r_{p2}$ is a radius of the driven gear, $\phi_1$ is an initial assembly reference angle from a reference position of the driving gear, $\phi_2$ is an initial assembly reference angle from a reference position of the driven gear, $\epsilon_1$ is a run-out of the driving gear, and $\epsilon_2$ is a run-out of the driven gear.

12. The power transmission unit according to claim 8, wherein the image receptor includes first to fourth image receptors provided for yellow, magenta, cyan and black colors, respectively, and wherein the intermediate gears and the image receptor axial gear are mounted with an objective function (O.F) satisfying the following Equation 4 set as an initial assembly angle in consideration of a phase difference between AC components of the first to fourth image receptors:

$$\text{O.F}=w1\times(F(Yx)+F(Mx)+F(Cx)+F(Kx))+w2\times F_\max(x)$$

where F(Yx), F(Mx), F(Cx) and F(Kx) represent magnitudes of the AC components of yellow, magenta, cyan and black print images on the first to fourth image receptors, respectively, F_max(x) represents the maximum deviation between colors when an initial assembly angle X is selected, and w1 and w2 represent a weight for respective terms.

13. The power transmission unit according to claim 8, wherein the plurality of intermediate gears includes:

a driving gear which is provided on a shaft of the driving source;

an idle gear which is driven in engagement with the driving gear; and a branch gear which engages with the idle gear and at least two of the plurality of image receptor axial gears, branches power transmitted from the idle gear, and transmits the branched power to the at least two image receptor axial gears.

14. The power transmission unit according to claim 8, wherein the number Tn of teeth of the n-th intermediate gear are set to be an integral multiple of a reduction ratio; and the teeth are engaged at the same position in each rotation of the image receptor to result in a constant pattern of radial change in the image receptor axial gear such that a radial change in the image receptor axial gears for the respective color is minimized.

15. An image forming apparatus comprising:

a plurality of image receptors;

a driving source to rotate the plurality of image receptors;

a power transmission unit to deliver power from the driving source to the image receptors, the power transmission unit comprising:

a plurality of image receptor axial gears co-axial with the plurality of image receptors; and a plurality of intermediate gears to transmit the power provided by the driving source to the image receptor axial gears, a number Tn of teeth of one of the plurality of intermediate gears located at an n-th position away from the plurality of image receptor axial gears satisfies the following Inequality 1:

$$(I/Rn)-0.2 \leq Tn \leq (I/Rn)+0.2$$

where Rn is a reduction ratio from the one of the plurality of intermediate gears located at the n-th position to the image receptor axial gear, and I and n are natural numbers, wherein the number Tn set to be substantially an integer multiple of the reduction ratio and is a natural number.

16. The image forming apparatus of claim 15, wherein the plurality of intermediate gears comprises a driving gear, a plurality of idle gears, and a plurality of branch gears, wherein the power transmission unit transmits power provided by the driving source to the plurality of image receptors via the intermediate gears.

17. The image forming apparatus of claim 16, wherein the plurality of intermediate gears includes a first branch gear to engage with a first idle gear and at least two of the plurality of image receptor axial gears.

18. The image forming apparatus of claim 16, wherein the plurality of intermediate gears includes a second branch gear to engage with a second idle gear and at least two of the plurality of image receptor axial gears.

19. The image forming apparatus of claim 16, wherein the plurality of idle gears and the plurality of branch gears are implemented by two layers of gears in consideration of a gear reduction ratio.

20. The image forming apparatus of claim 19, wherein a second layer gear of a first idle gear has a radius smaller than a first layer gear thereof, and the first layer gear engages with a first layer gear of a first branch gear of the plurality of branch gears.

21. The image forming apparatus of claim 19, wherein a second layer gear of a first branch gear of the plurality of branch gears has a radius smaller than a first layer gear thereof, and engages with two of the plurality of image receptor axial gears.

22. The image forming apparatus of claim 19, wherein the plurality of intermediate gears have reference marks to align and mount the intermediate gears in the power transmission unit.

23. The image forming apparatus of claim 22, wherein the reference marks of the intermediate gears represent reference marks to correspond to the first layer gears and second layer gears.

24. The image forming apparatus of claim 22, wherein the reference marks of the intermediate gears have a rotation angle of 0°.

* * * * *